United States Patent [19]

Kauffeldt et al.

[11] Patent Number: 4,756,048

[45] Date of Patent: Jul. 12, 1988

[54] DEVICE FOR CLEANING LARGE-AREA TEXTILE COVERINGS ESPECIALLY CARPETS AND CARPETED FLOORS

[76] Inventors: Horst Kauffeldt, Bachstr. 150; Thomas Kauffeldt, Kyffhauser Str. 27, both of, 4000 Dusseldorf, Fed. Rep. of Germany

[21] Appl. No.: 888,531

[22] Filed: Jul. 22, 1986

[30] Foreign Application Priority Data

Jul. 23, 1985 [DE] Fed. Rep. of Germany ..... 3526202

[51] Int. Cl.[4] ..... A47L 11/34

[52] U.S. Cl. ..... 15/320; 15/321

[58] Field of Search ..... 15/320, 321

[56] References Cited

U.S. PATENT DOCUMENTS 4,000,538 1/1977 Tissier ..... 15/320

4,103,519 8/1978 Davidson ..... 15/320 X

FOREIGN PATENT DOCUMENTS 2361894 6/1975 Fed. Rep. of Germany ..... 15/320

*Primary Examiner*—Chris K. Moore

*Attorney, Agent, or Firm*—Sprung Horn Kramer & Woods

[57] ABSTRACT

A device for cleaning large-area textile coverings, especially carpets and carpeted floors. The device has a rinse chamber that can be placed against the textile covering and slid over it, is open at the bottom, and has walls (8.11–8.12 & 8.21–8.22) that are double all the way around. The continuous space (8.3) between the outer and inner wall communicates with a vacuum space through a suction connection (12.1), creating an essentially annular suction nozzle that is open at the bottom. The rinse chamber rests against the textile covering (7.2) on at least the bottom edge of its outer wall, which is provided with sealing surfaces (8.112 & 8.122). Spray nozzles (13) and ultrasonic generators (16) are positioned in the space inside the rinse chamber (8). The water level (W) inside the rinse chamber (8) is regulated to keep the spray nozzles and ultrasonic generators immersed in the water. The dirty water emerging at the bottom edge of the inner wall (8.21 & 8.22) is constantly suctioned off.

20 Claims, 6 Drawing Sheets

DEVICE FOR CLEANING LARGE-AREA TEXTILE COVERINGS ESPECIALLY CARPETS AND CARPETED FLOORS

BACKGROUND OF THE INVENTION

The invention concerns a device for cleaning large-area textile coverings, especially carpets and carpeted floors, that has a adaptor communicating with a basic component through at least one hose connection and consisting of a rinse chamber that can be placed against the textile covering and slid over it, is open at the bottom, and has walls that are double all the way around at least in the section adjacent to the bottom, whereby the continuous space between the outer and inner wall communicates with the basic component through a water-removal connection, creating an essentially annular water-removal component that is open at the bottom, and whereby the rinse chamber rests, when placed against the textile covering, on at least its bottom edge, which is provided with sealing surfaces, and the inner space communicates with a fresh-water line through a water-supply connection.

A device of this kind is known in principle from GB Pat. No. 1 282 552. The rinse chamber in the known cleaning device is a telescoping housing. Once it has been placed on the surface to be cleaned, the rinse chamber is completely filled with water through a water inlet. The water is removed below the bottom edges of the bottom of the housing into an annular water-removal component surrounding the housing and communicating with the water-removal connection. The water is supposed to be supplied to the housing in a constant stream and removed from it in a constant stream. A suction pump can be attached to the water-removal component to remove the water. A constant closed flow of water is consequently supplied through the water inlet and removed through the water outlet. One drawback to the known device, in which an ultrasonic generator is immersed in the surface of the water inside the rinse chamber to promote the cleaning action, is that it is inappropriate for cleaning textile coverings. When a device of this type is placed on a carpet or carpeted floor, it is impossible to adequately seal off the circulating water from the exterior. The water arrives below the bottom edges of the outer walls and spreads over the carpet. Furthermore, constantly supplying the water only at the top of the rinse chamber and removing it at the bottom results in insufficient rinsing and cleaning.

German Pat. No. 2 743 530 specifies a device for cleaning large-area textile coverings with at least one spray nozzle attached to the fresh-water supply line and aimed at the textile covering, with at least one suction mouthpiece attached to vacuum spaces, with several suction fans driven by electric motors, with each fan connected to a separate vacuum space through its own suction connection, and with a dirty-water line that extends from the mutually connected vacuum spaces and through which the dirty water can be removed by means of a pump.

Carpets can be cleaned with this known device by, for example, spraying the fresh water, which can be heated and provided with a cleaning agent, onto the carpet subject to high pressure and suctioning it off again subsequent to a relatively brief action time. It is suctioned off through the suction mouthpieces, which communicate with the vacuum spaces.

SUMMARY OF THE INVENTION

With the aforesaid state of the art as a point of departure, the object of the present invention is to create a device of the aforesaid type that is appropriate for cleaning textile coverings and has an optimum cleaning action.

This object is attained in accordance with the invention wherein the water-removal component is a suction nozzle that communicates with a vacuum space positioned in the basic component that can be evacuated by means of a suction fan, in that a supplementary chamber that is open at the bottom is positioned inside the rinse chamber and has walls that are adjacent to the space inside the rinse chamber on all sides, whereby the bottom edges of the side walls are at a prescribed distance from the contact plane created by the sealing surfaces in that at least one spray nozzle that communicates with the fresh-water supply is positioned in the space inside the rinse chamber, and in that above the spray nozzle is a component that regulates the prescribed level of water in the rinse chamber.

Practical embodiments of the invention are recited also disclosed hereinafter.

The invention is based on the awareness that the cleaning process must take place inside the rinse chamber in several separate steps in order to optimize the cleaning action. A more or less three-stage process is carried out in terms of the direction of movement inside the rinse chamber of the device in accordance with the invention. In the first stage, the particles of dirt in the area of the textile covering that happens to be below the supplementary chamber are loosened. This can be done by introducing a chemical cleaning agent into the supplementary chamber or even by positioning an ultrasonic generator inside the supplementary chamber that is directed against the textile covering. It is important in this context to maintain a volume of water that is quiet and undisturbed by currents.

As the device moves on, the same area of the textile covering arrives under the influence of the spray nozzles, which spray on a narrow jet of fresh water, whirling up the already loosened particles of dirt during the second stage. The water with these whirling particles of dirt distributed through it is then immediately removed below the bottom rear edge of the inner wall of the rinse chamber and suctioned out under a powerful vacuum in the third stage.

It has been demonstrated that the device in accordance with the invention will produce an optimum cleaning action, with only a little water remaining in the textile covering due to the particular method employed.

In one practical embodiment of the invention, in which the aforesaid ultrasonic generator is employed in a known way to loosen the particles of dirt, the positioning of the generator inside the supplementary chamber is especially important. An ultrasonic field reacts, as is known, with particular sensitivity to discontinuities in density and to currents inside the medium that it penetrates. The supplementary chamber, which is connected in the form of a communicating vessel only at the bottom to the rinse chamber, allows the ultrasonic field to occur in relatively quiet water, so that no reflecting discontinuities in density can occur.

The water level is simultaneously regulated in such a way that a water level of constant height is maintained in the rinse chamber, ensuring that both the ultrasonic generator and the spray nozzles are constantly immersed in the water. The rinse chamber can be a floor adapter that can be slid or traveled over the floor and that communicates through one or more vacuum lines with a basic component of a known type in which the requisite vacuum is generated and in which the electrical components that generate the ultrasound and if necessary regulate the supply and/or removal of water can be accommodated.

The device in accordance with the invention can basically be employed with pure water, although the textiles can also additionally be preliminarily treated with cleaning agents.

One embodiment of the invention will now be specified with reference to the attached drawings, wherein:

DETAILED DESCRIPTION OF THE PREFERRED EMBODIMENTS

Figure 1:
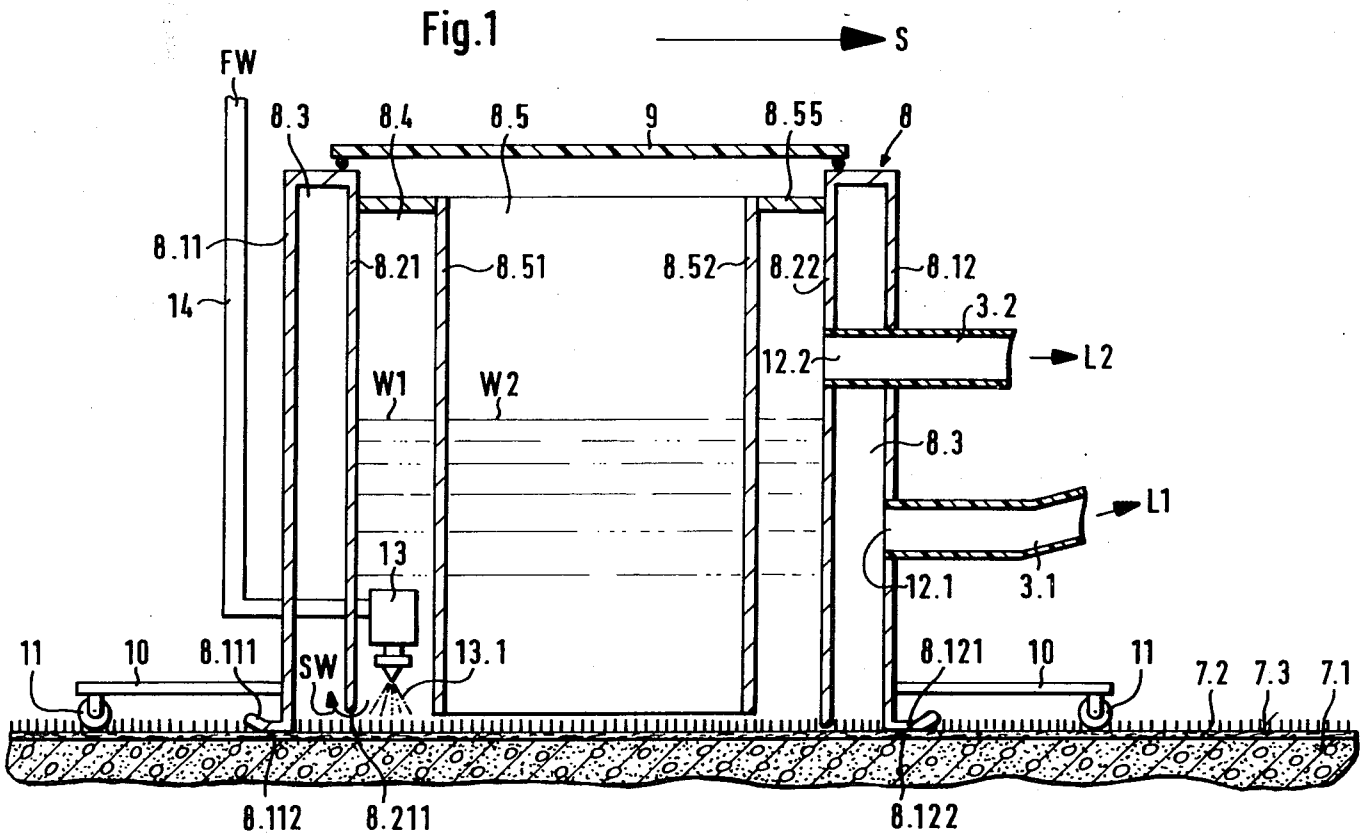
FIG. 1 is a schematic vertical section through one embodiment of a floor adapter for a device for cleaning large-area textile coverings according to the invention.

The device illustrated highly schematically in FIGS. 1 through 4 has a basic component 1 containing one or more vacuum spaces in a way that is not illustrated but is known from German Pat. No. 2 743 530. An unillustrated suction fan produces a vacuum in the spaces. Basic component 1 has at least one suction connection 2. A vacuum hose 3 leading to a floor adapter is connected to suction connection 2. Basic component 1 also has a connection 4 for removing dirty water. A control panel 5 has in a known way the switches and displays necessary to turn the device on and off and to control it. When the device includes an ultrasonic generator, the electric energy to operate it can be obtained through a connecting cable 6.

FIG. 1 shows one embodiment of a floor adapter in which the particles of dirt are loosened for example by adding a chemical cleaning agent.

The floor adapter has a rinse chamber 8 in the form of a housing that has an essentially rectangular cross-section and that can be suspended in such a way that it can be raised and lowered in a frame 10 that is provided with rollers 11.

Rinse chamber 8, which is open at the bottom, has walls in the form of a continuous double wall. There is a suction space in the form of an essentially annular intermediate space 8.3 between the four continuous outer walls 8.11, 8.13, 8.12, and 8.14 and the four also continuous inner walls 8.21, 8.23, 8.22, and 8.24. This suction space communicates through a suction-connection opening 12.1 and a hose connection 3.1 with at least one vacuum space in basic component 1. The bottom edge of the outer walls is surrounded by a continuous flange labeled 8.111 or 8.121 in FIG. 1 and extending, as will be evident from FIG. 3, also around the outer walls, which are not visible in FIG. 1. The rinse chamber is applied to the textile covering that is to be cleaned—which is represented in FIG. 1 as a carpeted floor with a basic fabric 7.2 and a nap 7.3 resting on a pavement 7.1—on its surrounding flange, the bottom of which is a machined-flat sealing surface 8.112 and 8.122.

Rinse chamber 8 can be open at the top or covered with a lid 9 that consists for practical results of transparent material, Plexiglas for example, so that the rinse chamber can be monitored during the cleaning process. The surrounding flange can also have ribs or skids on the bottom, preferably paralleling the direction S of motion. In this case it is especially important for inner walls 8.22, 8.23, and 8.24 to extend all the way to the basic fabric to prevent the rinse water from escaping.

The top of the space 8.4 in rinse chamber 8 inside the inner walls can communicate through a connection opening 12.2 and a hose connection 3.2 with a vacuumized or pressurized space in basic component 1. Both hose connections 3.1 and 3.2 can either empty individually in a way not illustrated into basic component 1 or, if the same pressure is to prevail in both the rinse chamber and the suction chamber, together into a collecting hose 3.

A supplementary chamber 8.5 that is open at the bottom is also positioned inside the space 8.4 inside the rinse chamber. The walls 8.51, 8.52, 8.53, and 8.54 of supplementary chamber 8.5 are surrounded on all sides by the space 8.4 inside the rinse chamber. The bottom edges of walls 8.51 to 8.54 are at a prescribed short distance from the surface of the textile covering or from the contact plane of the device as defined by sealing surfaces 8.112 and 8.122. Thus, the space inside supplementary chamber 8.5 is connected to the space 8.4 inside rinse chamber 8, creating communicating vessels out of the two spaces, while the floor adapter rests on the textile covering, so that the water level W1 in the space inside the rinse chamber and the water level W2 in the space inside the supplementary chamber are equal in height in equilibrium. Supplementary chamber 8.5 is fastened to rinse chamber 8 by retainers 8.55.

Three spray nozzles 13 are positioned in the space 8.4 inside rinse chamber 8 and attached to a fresh-water supply line 14. The prescribed direction of displacement of rinse chamber 8 is indicated by arrow S.

Figure 2:
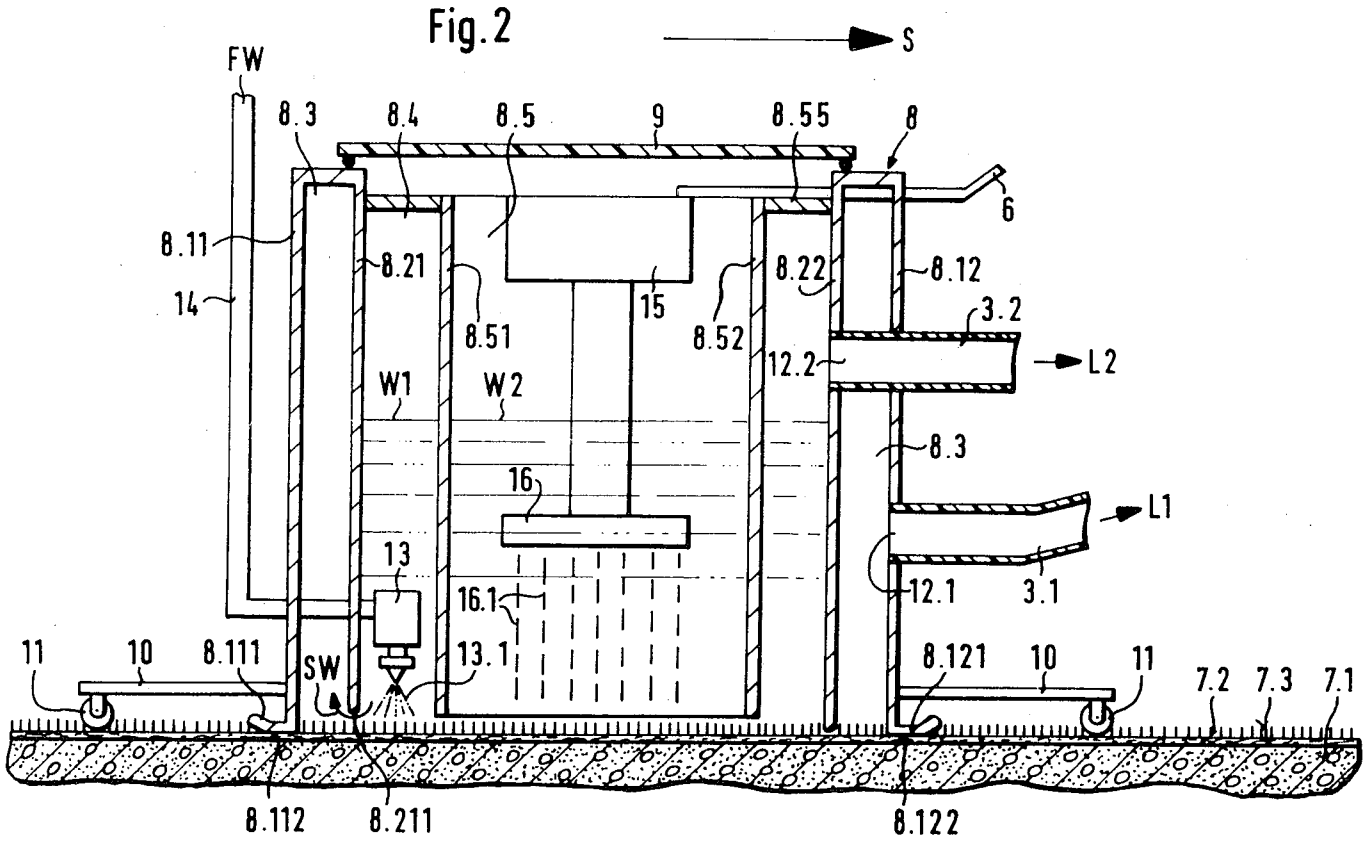
FIG. 2 is a variation of the embodiment illustrated in FIG. 1.
Figure 3:
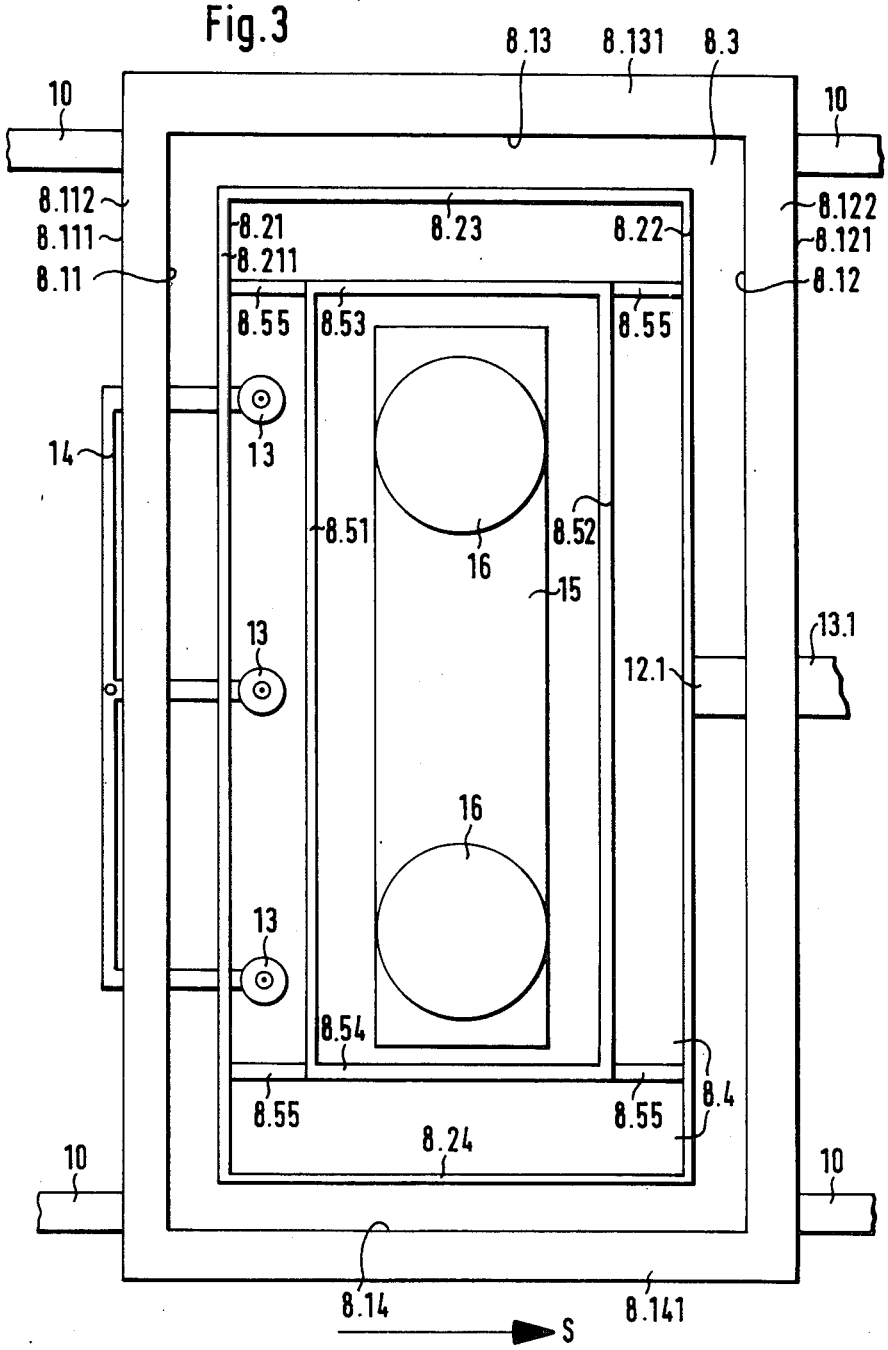
FIG. 3 is a bottom view of the floor adapter in FIG. 2.

The embodiment of the floor adapter illustrated in FIG. 2 differs from that illustrated in FIG. 1 only in that a component 15 for generating ultrasound is positioned inside supplementary chamber 8.5 and can be connected to basic component 1 by a connecting cable 6. Two downward-directed ultrasonic generators 16 are positioned on component 15.

Supplementary chamber 8.5 or ultrasonic generators 16 are positioned for reasons that will be discussed later herein positioned in front of spray nozzles 13 in direction S of displacement. The bottom edge 8.211 of the inner wall 8.21 that is to the rear in relation to direction S of displacement is at a prescribed distance of a few millimeters from the contact plane constituted by sealing surfaces 8.112 and 8.122, whereas the bottom edge of forward inner wall 8.22 extends for example all the way down to the textile covering.

There are three spray nozzles 13 in the embodiments specified herein and two ultrasonic generators in the embodiment illustrated in FIG. 2 in rinse chamber 8. It is of course also possible, depending on the size of rinse chamber 8.4 or of supplementary chamber 8.5 to have different numbers of spray nozzles and ultrasonic generators.

The floor adapter can be displaced and guided through rods that are not illustrated but are in themselves known and mounted on the housing. The device can also travel on its own on rollers 11.

How the device illustrated in FIGS. 1 through 4 operates will now be specified. The floor adapter is positioned on the carpeted floor 7.2 to be cleaned. Fresh water FW is supplied through spray nozzles 13, specifically in an amount such that the water in space 8.4 rises to level W1. The water below the bottom edge of inner wall 8.21 and to a slight extent also under the bottom edges of inner walls 8.22, 8.23, and 8.24 will simultaneously be removed through suction opening 12.1 and hose connection 3.1 in the direction indicated by arrow L1 due to the vacuum in suction space 8.3. Supplementary chamber 8.5 is filled with water, which settles at water level W2 due to the communication between the spaces. In this state of equilibrium the flow of water in supplementary chamber 8.5 is insignificant. The supply and removal of the water are mutually adjusted in such a way as to maintain water levels W1 and W2 high enough for both spray nozzles 13 and, in the embodiment illustrated in FIG. 2, at least the emitting surfaces of ultrasonic generators 16 to be immersed in the water. Once water level W1 arrives at suction opening or overflow opening 12.2, the surplus water will be removed through hose 3.2 in the direction indicated by arrow L2.

Either a cleaning agent introduced into supplementary chamber 8.5 or the field 16.1 generated by ultrasonic generators 16 will lift or loosen any dirt adhering to carpeted floor 7.2 or nap 7.3. As the adapter continues to move in the direction indicated by arrow S, the area of the carpeted floor that has been treated in this manner will arrive below spray nozzles 13, and the dirt loosened or dissolved by the emerging jet 13.1 of water will be completely dissolved and distributed throughout the water. Thus, at this stage of the treatment, the water that is loaded with the particles of dirt will be concentrated essentially to the front or at the sides, whereas a region in which almost clear water flows along the carpeted floor and is suctioned up in the direction indicated by arrow SW will be created behind spray nozzles 13 in relation to the direction S of displacement. Thus, for each area of the carpeted floor, the particles of dirt are first loosened and dissolved as the floor adapter moves in direction S of displacement, followed by a sort of "underwater massage" accompanied by further dissolution and distribution of the particles of dirt, and finally by a sort of rinsing with fresh water. This ensures optimum cleaning action.

The supply and removal of the water can be set constant. The volume of supply can be set in such a way that water level W1 will terminate precisely at the bottom edge of suction opening 12.2 and the removal adjusted so that a certain proportion of the water will constantly be removed in the direction indicated by arrow L2.

Figure 5:
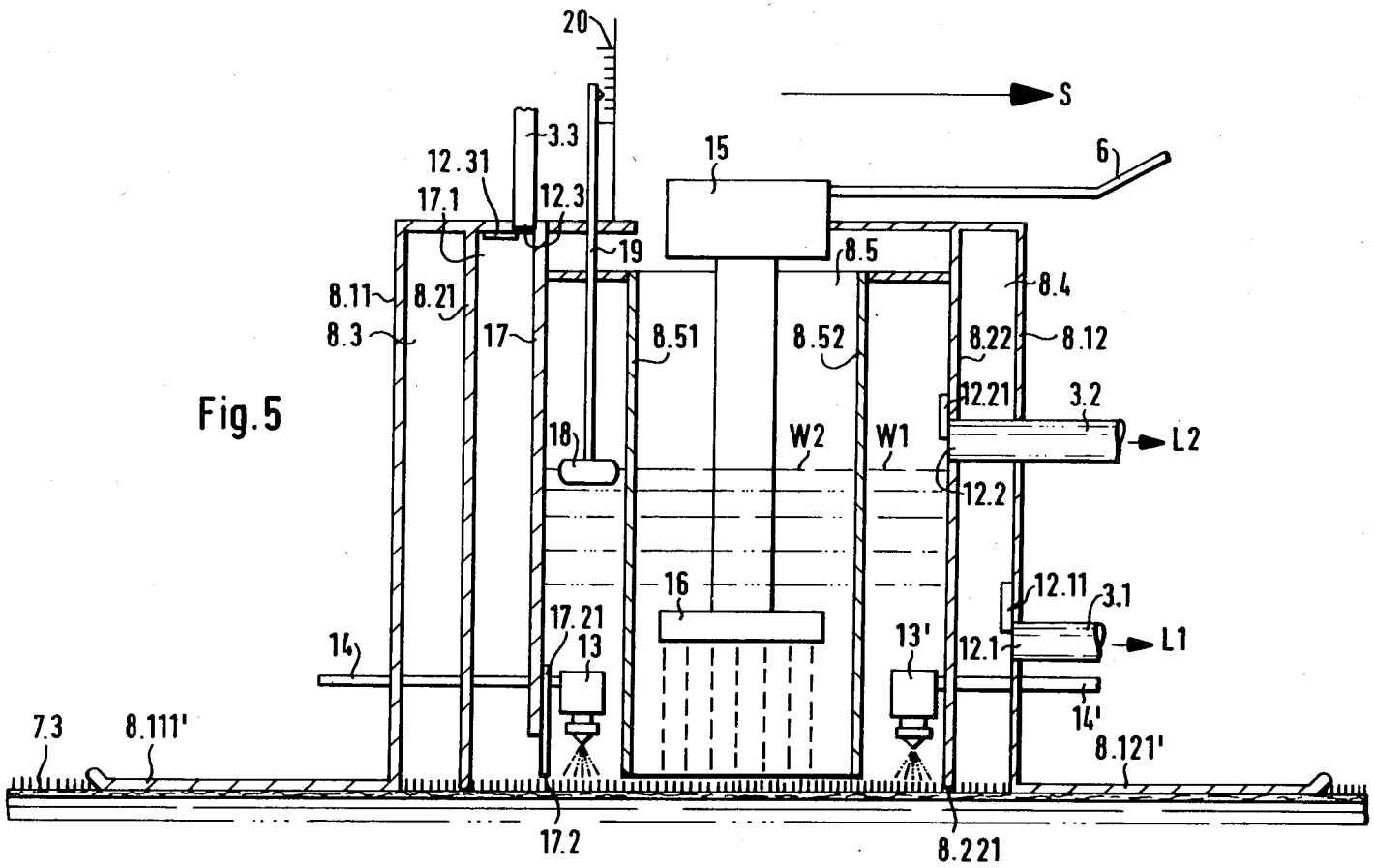
FIG. 5 is a vertical section similar to that in FIG. 1 through another embodiment of the floor adapter.

FIG. 5 illustrates, similarly to FIG. 1, a vertical section through a floor adapter that is somewhat different from the embodiment illustrated in FIG. 1. The differences can be embodied separately or all together. Similar components are labeled with the same reference numbers employed in FIG. 1. The space 8.4 inside the rinse chamber in this embodiment is open at the top, allowing total atmospheric pressure to act on water level W1 or W2. In this case no air is suctioned off through line 3.2, and opening 12.2 functions only as an overflow opening. The embodiment also has an additional wall 17 that parallels inner wall 8.21 behind spray nozzles 13 in the direction S of displacement, creating a supplementary chamber 17.1 from which air and invading water can be suctioned through suction connection 3.3. In this case all the inner walls 8.21 to 8.24 extend down and come into contact with the basic fabric 7.2 of the carpeted floor, so that only a little liquid will penetrate into annular chamber 8.3 and is suctioned off at 3.1 along with the air. A considerable volume of rinse water penetrates on the other hand out of space 8.4 below the bottom edge 17.2 of wall 17, which is a few millimeters off the floor, and is suctioned out of space 17.1 along with the air. Suction hoses 3.1, 3.2, and 3.3, must be large enough to prevent impedance from interfering with the suction even at a high suction speed and as the ratio of the mixture of water and air changes.

This embodiment also has a float 18 in space 8.4. The rod 19 of the float extends up out of the rinse chamber and the level of the water can be read from a scale 20. Indicating the level of the water makes it possible to regulate the supply 14 of fresh water to spray nozzles 13 either manually or automatically, electrically or mechanically that is, and maintain the desired water level. If the water rises to high in spite of this regulation, water can be bled off through runoff opening 3.2.

The water level can also be measured with another type of instrument instead of a float, by means of an electric or magnetic field for example. The results can also be supplied electrically to the control panel 5 on basic component 1 and automatically adjust the freshwater supply 14 and other mechanisms automatically at that point.

This embodiment also lacks a frame 10 and rollers 11, and the whole floor adapter rests on the especially wide flanges 8.111' or 8.121' and on flanges 8.131' and 8.141' on the longitudinal sides. The flanges, especially the flanges 8.111' and 8.121' on the transverse sides, can have skids or ribs (unillustrated) on the bottom to facilitate displacing the floor adapter in the direction indicated by arrow S. If there are skids on the transverse walls, the bottoms of the flanges on the longitudinal walls must be lower. Since most of the rinse water is suctioned off through chamber 17.1, nap 7.3 will be extensively dried in the annular intermediate space 8.3 that the air is suctioned out of through hose connection 3.1.

Figure 4:
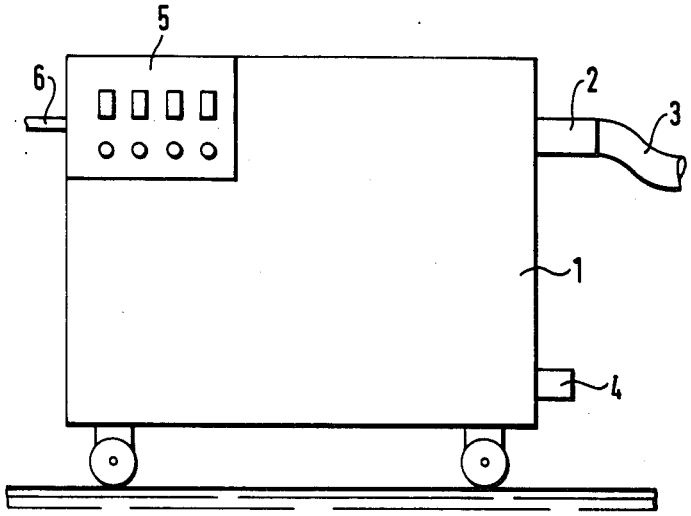
FIG. 4 is a smaller-scale illustration of a basic component for connecting a floor adapter of the type illustrated in FIGS. 1 through 3.

The suction openings 12.1, 12.2, and 12.3 in the embodiment illustrated in FIG. 4 can also be closed off partly or completely by slides 12.11, 12.21, and 12.31, making it possible to vary the suction or the volume of water flowing off through opening 12.2. The gap between wall 8.21 and the basic fabric of the carpet in FIG. 1 or between wall 17 and the basic fabric of the carpet can also, as illustrated in FIG. 5, be varied by means of a slide 17.21. This slide can be adjusted either by hand before commencing the cleaning process or by appropriate mechanisms like Bowden cables during the cleaning process, whereby it is essential for a powerful stream of rinse water to flow constantly through the gap below bottom edge 8.221 or 17.2. The slide can of course also be adjusted from the control panel 5 on basic component 1, and in fact all adjustments can be carried out from the control panel automatically or by hand. All adjustments can also be carried out depending on the level of water in chamber 8.4, which must always be above the level of the beam from the ultrasonic generators and above that of spray nozzles. Rinse water can be bled off from basic component 1 from time to time through runoff connection 4.

The control panel can also have a blocking component that prevents ultrasonic component 15 from being activated when a water level is displayed at the panel that is too low to allow ultrasonic generators 16 to extend into the water.

Since the textile coverings that are to be cleaned do not always have a completely flat surface, as when for example the pavement 7.1 itself is not completely flat, it can be practical to have sealing components on the bottom of the flanges around rinse chamber 8 that automatically adjust to any irregularities in the floor and accordingly ensure a satisfactory seal at the outer edges.

Figure 6:
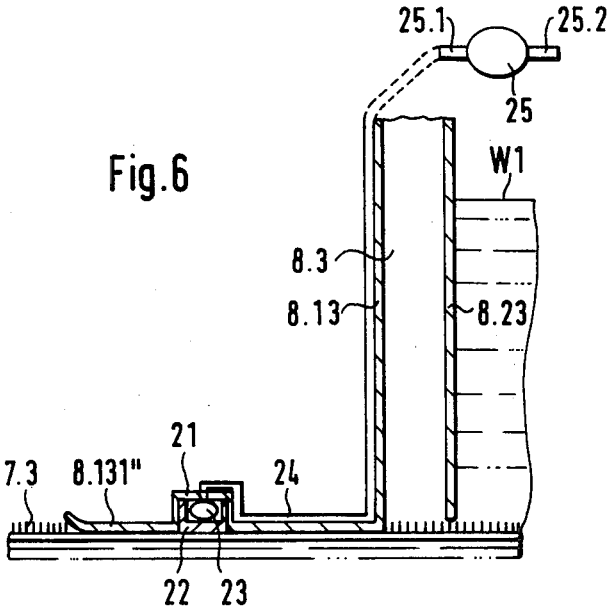
FIG. 6 illustrates part of the floor adapter in FIG. 5 in a variation of that embodiment.
Figure 7:
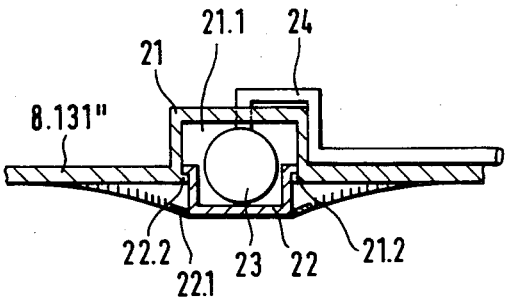
FIG. 7 is a larger-scale detail of the embodiment illustrated in FIG. 6.

FIGS. 6 and 7 illustrated a variation of the embodiment of a floor adapter illustrated in FIG. 5. This embodiment is equipped with a sealing component of the aforesaid type. FIG. 6 illustrates only part of the floor adapter, which has a flange 8.131" that extends for example parallel to direction S of displacement. The flange has a mount 21. The space inside mount 21 forms, as will be evident from FIG. 7, a groove 21.1 that is open at the bottom. A movable sealing strip 22 is positioned in groove 21.1. Strip 22 has a U-shaped cross-section that is open at the top and is inserted in groove 21.1 in such a way that it can be extracted down toward the textile covering. Catches 22.2 operate in conjunction with stops 21.2 on flange 8.131" to prevent sealing strip 22 from sliding or falling out completely. The sealing bottom of sealing strip 22 has edge flanges 22.1 on each side that can be made out of a flexible material and can rest against the bottom of flange 8.131". Inside groove 21.1 between the base of the groove and the bottom of sealing strip 22 is a rubber tube 23 that communicates through a tube connection 24 with an air pump, which is represented in FIG. 6 as a simple rubber ball. Pump 25, which is manually activated, has check valves 25.1 and 25.2 on each end. The valves work in opposition to each other.

How the sealing components are activated will now be described. With the floor adapter resting on the textile covering, rubber tube 23 is subjected by means of pump 25 to a pressure that is high enough to force the bottom of flange 8.131" flat and tight against textile covering 7.3 on the flat floor. The weight of the overall device prevents the pressure inside rubber tube 23 from forcing sealing strip 22 out and hence lifting the device. If the floor adapter travels over an undulation in the floor and the surface of textile covering 7.3 yields downward and assumes the shape represented by the broken line in FIG. 7 for example, the pressure in rubber tube 23 will force sealing strip 22 out and down at that point and will seal off the resulting gap. To allow the sealing components to adjust to undulations along the length of groove 21.1 as well, it is practical for sealing strip 22 to be made out of a flexible material like plastic.

It will be appreciated that the instant specification and claims are set forth by way of illustration and not limitation, and that various modifications and changes may be made without departing from the spirit and scope of the present invention.

What is claimed is:

1. In a device for cleaning a large-area textile covering, which is movable in a direction of travel and has a bottom disposed on the textile covering, the improvement comprising: means forming an open-bottomed central chamber, means forming an open-bottomed annular rinsing chamber around the central chamber and contiguous thereto, means forming an open-bottomed annular suction chamber around the rinsing chamber and contiguous thereto and including an outer wall having a bottom edge in contact with the textile covering during use and defining a contact plane, means for evacuating the suction chamber, wherein the means forming the central chamber include walls corresponding to inner walls of the rinse chamber and having bottom edges disposed above the contact plane; at least one spray nozzle disposed in the rinsing chamber and facing the bottom thereof and receptive of a supply of fresh water and means for maintaining a predetermined level of liquid in the central and rinsing chambers above the at least one spray nozzle.

2. The device as in claim 1, wherein the walls of the central chamber are impermeable to water.

3. The device as in claim 1, wherein the at least one spray nozzle is disposed behind the central chamber in relation to the direction of travel and the bottom edge of the inner wall of the rinsing chamber adjacent the at least one spray nozzle is disposed above the contact plane.

4. The device as in claim 3, further comprising means for adjusting the distance between the bottom edge of the inner wall of the rinsing chamber and the contact plane comprising a perpendicularly displaceable slide is positioned on the inner wall.

5. The device as in claim 1, further comprising a plurality of spray nozzles in the rinsing chamber.

6. The device as in claim 5, wherein the plurality of spray nozzles are positioned behind the central chamber in relation to the direction of travel.

7. The device as in claim 1, further comprising at least one ultrasonic generator positioned in the central chamber and below the predetermined liquid level.

8. The device as in claim 1, wherein the means forming the suction chamber include means forming an annular outer chamber open at the bottom and an annular intermediate chamber that is open at the bottom is positioned between the rinsing chamber and the outer chamber and the intermediate chamber communicates with the outer chamber through a suction connection.

9. The device as in claim 1, further comprising continuous flanges positioned around the bottom of the outer walls of the suction chamber.

10. The device as in claim 9, wherein the rinsing chamber and flanges are made out of metal and wherein the flanges have sealing surfaces that are machined flat.

11. The device as in claim 9, wherein the bottoms of the continuous flanges have skids.

12. The device as in claim 9, further comprising means mounting sealing strips on the bottom edges of the flanges and means for lowering the strips to conform to the contour of the surface of the textile covering that is to be cleaned, wherein the strips are positioned on the bottom of the flanges at least along the sides that parallel the direction of travel.

13. The device as in claim 12, wherein the sealing strips have a U-shaped cross-section and are positioned in grooves on the bottom of the flanges for displacement perpendicular to the contact plane and further comprising an inflatable rubber tube connectable to an air pump and positioned between the sealing strips and the grooves.

14. The device as in claim 9, wherein the bottoms of the continuous flanges have ribs.

15. The device as in claim 1, wherein the bottom edge of the outer wall of the suction chamber has sealing lips made out of a soft material.

16. The device as in claim 1, wherein the rinsing chamber is closed at the top.

17. The device as in claim 16, wherein the means for maintaining the liquid level has a runover opening positioned at a prescribed level at the inner wall of the suction chamber and communicates with a vacuum space.

18. The device as in claim 1, wherein the means for maintaining the liquid level comprises a float positioned in the rinsing chamber for measuring the level of the liquid therein and means for regulating the supply of liquid to the rinse chamber in accordance with the result of the float.

19. The device as in claim 1, further comprising a frame from which the rinse chamber is suspended, wherein the frame is mounted on rollers and has means for raised and lowering same.

20. The device as in claim 1, wherein the means for maintaining the liquid level comprises a float positioned in the rinsing chamber for measuring the level of the liquid therein and means for regulating the supply of liquid to the rinse chamber in accordance with the result of the float closable at the top with a lid.

* * * * *